United States Patent [19]

Stokes

[11] 4,299,561

[45] Nov. 10, 1981

[54] RECOVERY OF HEAT FROM FLUE GAS

[76] Inventor: Keith J. Stokes, 66 Davis Hill Rd., Weston, Conn. 06883

[21] Appl. No.: 131,435

[22] Filed: Mar. 18, 1980

[51] Int. Cl.[3] ..... F27D 17/00

[52] U.S. Cl. ..... 432/28; 110/254; 122/20 B; 432/180

[58] Field of Search ..... 432/28, 29, 30, 180, 432/181; 110/254; 126/400; 122/20 B

[56] References Cited

U.S. PATENT DOCUMENTS

| | | | |
|---|---|---|---|
| 2,522,639 | 9/1950 | Royster | 432/28 |
| 3,170,678 | 2/1965 | Keefer | 432/28 |
| 4,121,563 | 10/1978 | Gold | 126/400 |

*Primary Examiner*—John J. Camby

*Attorney, Agent, or Firm*—Kirschstein, Kirschstein, Ottinger & Cobrin

[57] ABSTRACT

A system for recovering heat from combustion flue gas, which transfers heat from the flue gas into combustion-supporting air, which is then used to burn a fuel in a combustion zone in a furnace or the like, so that useful heat is generated and a hot combustion flue gas is formed. Two heat sinks are provided, each for alternate absorption of heat from the hot flue gas, and desorption of heat into ambient combustion air so that the air is preheated. A reversible fan or blower is associated with each sink. The hot flue gas is passed successively through one heat sink and fan to atmospheric discharge for a finite time interval, while concomitantly passing cold and usually ambient combustion air successively through the other fan and heat sink so that the air is heated and a preheated combustion air stream is formed, which is subsequently passed to the combustion zone. After the finite time interval, the reversible fans are reversed for another finite time interval usually equal to the first time interval. Concomitantly, the flue gas is then passed to the othyer heat sink and the preheated combustion air now discharged from the one heat sink is passed to the combustion zone. Increments of preheted combustion air stream are thus alternately formed in the one heat sink and the other heat sink, and heat is recovered from the hot flue gas alternately in the two heat sinks.

11 Claims, 4 Drawing Figures

RECOVERY OF HEAT FROM FLUE GAS

BACKGROUND OF THE INVENTION

1. Field of the Invention

An improved system for recovering heat from combustion flue gas.

2. Description of the Prior Art

The ever-recurring energy crises and large increase in the cost of fuel oil and other fuels has necessitated more efficient and economical usage of fuels, and has mandated a maximization of the recovery of heat from combustion processes. Thus in recent years it has become economically attractive to maximize heat recovery even though higher capital costs for facilities and equipment are encountered.

The recovery of heat from flue gas from industrial furnaces has been practiced in large-scale installations for many years. Thus it is common practice in facilities where a fuel is burned in a furnace e.g. to generate steam for industrial usages, and especially in large scale steam electric power plants where high pressure steam is generated in boilers by vaporizing boiler feed or condensate water, and the steam is expanded in a steam turbine which drives an electrical generator, to install complex and costly waste heat boilers, and economizers which recover a final increment of heat from the combustion flue gas via the preheating of the boiler feed or condensate water prior to passing the water to the steam boiler.

Heretofore it has not been economical to recover heat from the flue gas generated in smaller furnaces, such as those found in private homes and apartment houses, because the capital cost was prohibitive relative to the heat savings realized. However, as mentioned supra, the ever-rising price of various fuels, and especially fuel oil and natural gas, has now made it economically feasible to contemplate capital investment for the recovery of heat from even small amounts of flue gas as generated at relatively low flow rates and temperatures in private dwellings and apartment houses.

It has been known in the prior art to recover heat from flue gas via indirect heat exchange with air, the heated air then being used to support combustion of the fuel such as gas, oil or coal in the furnace which generates the flue gas. It has also been known to accomplish the indirect heat exchange by alternately passing the hot flue gas and cold combustion air through a heat recuperator or regenerator, which is a vessel filled with brick checkerwork or the like. The hot flue gas heats the bricks and is cooled, and subsequently the combustion air cools the bricks and is heated. Such schemes are described on pages 9–48 through 9–51 of the 5th Edition of the Chemical Engineers' Handbook by Robert H. Perry and Cecil H. Chilton, published 1973 by McGraw-Hill Book Company.

Among the prior art relative to systems for recovering heat from hot flue gas by preheating ambient combustion air may be mentioned U.S. Pat. Nos. 3,207,493; 1,925,941; 1,835,210 and 1,505,767.

SUMMARY OF THE INVENTION

1. Purposes of the Invention

It is an object of the present invention to provide an improved system and method for recovering heat from flue gas.

Another object is to provide such a system which improves efficiency and economy in the usage of fuels.

A further object is to provide an improved system for recovering heat from hot flue gas by preheating cold or ambient combustion air.

An additional object is to provide such a system which helps in alleviating the energy shortage and energy crises, by recovering heat from fuel combustion in an improved manner and thereby conserving fuel and curtailing fuel usage.

Still another object is to provide a system for the recovery of heat from flue gas which is feasible and amenable to usage in small-scale furnace installations such as are to be found in private dwellings or homes, apartment houses, office buildings, public buildings or the like, as well as in large-scale furnace installations such as those in plants, factories, steam-electric power plants, and other commercial and industrial installations.

Still a further object is to provide a system and method for recovering heat from combustion flue gas which is simple and efficient and of low capital cost.

Another object is to provide a system and method for the recovery of heat from flue gas which provides the simplest piping and instrumentation of all the possible alternates.

Another object is to provide such a fail-safe system suitable for installation even in a domestic furnace such as are to be found in private dwellings and homes, and in apartment houses.

Another object is to provide such a system which is better than alternative systems that would use on-off valves to direct the flow of combustion air and flue gas, which alternate systems present design difficulties and reduced safety.

Another object is to provide a dual fans system which allows a pressure in the furnace very close to atmospheric.

Another object is to provide such a system using dual fans, as opposed to a single fan, in order to maintain a slight negative pressure in the furnace in both modes of operation.

Another object is to provide an improved system of this type having greater safety, reliability and economic impact.

Another object is to provide such a system for use in small scale installations, as compared to large scale items which are in continuous operation, receive regular maintenance and are regularly inspected by operators.

Another object is to provide a system for economical regenerative air preheaters which is acceptable in domestic furnace applications and in which a much simpler means of flow control is necessary.

Another object is to provide such a system featuring fans which operate alternately in the forced draft and induced draft modes.

Another object is to recover heat from combustion flue gas, and concomitantly preheat combustion air, in a more efficient manner.

Another object is to save fuel in a combustion process.

Another object is to provide a system and method for recovering heat from combustion flue gas which provides reversing fans which eliminate the need for a valve in the cold and corrosive exhaust gas (flue gas).

Another object is to eliminate the need for a reversing or switching valve in such a system and thereby improve the reliability of such a system by eliminating an additional moving part and allowing normal operation automatically without operator supervision.

Another object is to provide such a system which eliminates the reversing or switching valve, which is subject to swings in temperature whenever the cycle changes from heating to cooling or vice versa, which in time causes the valve to jam or leak, and which is exposed to corrosive attack by sulfuric and sulfurous acids derived from sulfur dioxide in the flue gas.

These and other objects and advantages of the present invention will become evident from the description which follows.

2. Brief Description of the Invention

In the present invention, an improved system and method is provided for recovering heat from combustion flue gas using combustion-supporting air as the heat recipient, i.e. the cold usually ambient combustion air is preheated prior to passing to the combustion zone by transfer of heat from hot flue gas. The increment of preheating of the combustion air stream reduces the amount of fuel which has to be burned in the furnace to produce a given amount of heat energy.

The system and method basically entails the provision of a fuel stream and a preheated combustion air stream to the furnace.

The fuel stream typically is a fossil fuel such as natural gas principally contaning methane, crude oil, refined fuel oil, or coal, although in special instances other fuels such as wood, Bunker C residual oil, sludge acid, bagasse, garbage or the like may be the material being burned in the furnace. The fuel stream is burned with the preheated combustion air stream in a combustion zone in the furnace, so that useful heat is produced and a combustion flue gas stream is generated at highly elevated temperature. In some instances, the hot combustion flue gas stream may be initially partially cooled in a waste heat boiler and/or an economizer, prior to further cooling in accordance with the present invention, and it will be understood by those skilled in the art that such an alternative is within the context and scope of the present invention.

A first heat sink and a second heat sink are provided. Each heat sink, to be described in detail infra, constitutes a means to alternately absorb heat from a hot gas stream, so that the hot gas stream is cooled, and desorb heat into a cold gas stream, so that the cold gas stream is heated. A first reversible fan or blower is provided and associated with the first heat sink, and a second reversible fan or blower is provided and associated with the second heat sink. Respective means such as an induction-type electric motor, a steam turbine or a gasoline or diesel engine is provided to drive the first fan and the second fan.

The combustion flue gas stream is passed successively through the first heat sink and the first fan to atmospheric discharge for a first finite time interval, during which the first heat sink absorbs heat from the hot flue gas and is heated to an elevated temperature. Concomitantly, a cold usually ambient combustion air stream is passed successively through the second fan means and the second (now hot) heat sink, so that the air is heated and the preheated combustion air stream is formed and passed to the combustion zone. This removes heat from the second heat sink and cools it to a lower temperature.

The first and second reversible fans are reversed after the first finite time interval and for a second finite time interval, while passing the combustion flue gas stream to the second heat sink and passing the hot gas (air) stream discharged from the first heat sink to the combustion zone during the second time interval. Thus, during the second time interval the combustion flue gas stream flows successively through the second heat sink and the second fan to atmospheric discharge, so that the second heat sink is reheated, while the cold usually ambient combustion air stream passes successively through the first fan and the first heat sink, so that an additional increment of preheated combustion air stream is formed in the first heat sink.

Typically, the first and second finite time intervals are generally of equal duration; usually the first and second finite time intervals are each in the range of about 2 to 20 minutes duration. In most instances the cold combustion air stream will be ambient air, although it is feasible to utilize low level heat from another source to initially preheat ambient air somewhat in order to form the cold combustion air stream.

In a preferred embodiment, the first and second reversible fans are operated in tandem and driven by a common primary drive. Typically the common primary drive is a reversible drive means, in which the sense of rotation is reversed between the first and second time intervals. As mentioned supra, engines or motors such as an induction-type electric motor, a steam turbine or a gasoline or diesel engine are feasible for usages as the fan drive means, in this case the common primary drive.

The first reversible fan will usually operate in an induced draft mode during the first finite time interval and a forced draft mode during the second finite time interval, and the second reversible fan will operate in a forced draft mode during the first finite time interval and in an induced draft mode during the second finite time interval. In this manner, each fan handles flue gas only when it has been previously cooled by a heat sink.

In a preferred embodiment, each heat sink is an enclosure, such as a container or vessel, filled with a solid particulate material such as brick checkerwork, rocks, metal filler such as spherical particles or shavings, alumina or magnesia particles, particulate silica, glass or quartz, etc. Preferably, each of the enclosures is vertically oriented, and the solid particulate material is disposed in multiple layers on foraminous horizontal trays within the enclosure. Each enclosure in this case will usually have an upper and a lower opening, the combustion flue gas flowing downwards in turn alternately through each of the enclosures, and the combustion air flowing upwards in turn alternately through each of the enclosures. In this embodiment of enclosure, it is preferred to provide means such as a drain or faucet at the lower end of each enclosure, to drain off condensate derived from the cooling of the combustion flue gas.

Typically, the combustion flue gas is cooled from an initial temperature in the range of about 300° F. to about 1200° F., to a final temperature in the range of about 100° F. to 400° F.; and the combustion air is preheated from ambient temperature to a final temperature in the range of about 200° F. to 1100° F.

To summarize briefly, the present invention concerns the configuration and arrangement of dual reversible fans or blowers in a system for the recovery of heat from combustion flue gas, and the piping layout which facilitates their dual mode of operation. A furnace is provided, and combustion air is preheated for the furnace by heat recovered from the flue gas. Two heat sinks are used in rotation to exchange heat between the flue gas and the combustion air. At any time that the furnace is in operation, the flue gas is passing through one heat sink while the combustion air is passing through the other. Thus, one heat sink is heating up while the other is cooling down. Periodically or cyclically, the flows to the heat sinks are reversed, thus the flue gas heat is transferred to the combustion air. The heat sinks may contain rocks, glass or metal filler material. To counteract temperature equalization between top and bottom of the heat sinks, the heat sink may consist of multiple layers of solid particulate material separated by gaps of air or material of low thermal conductivity. Thus, the system operates with alternate fan modes, with each fan alternately operating in the induced draft (ID) and forced draft (FD) modes, the other fan operating in the opposite mode in each case. The fans may be linked by a common drive shaft to increase their inter-dependence, and thereby improve the system's simplicity and safety. An important aspect of the invention is that the fans operate alternately in the FD/ID mode and can be mechanically interconnected if desired.

The use of the heat sinks will save fuel. Typically, if the stack temperature is 600°, installation of these heat sinks could cool the stack gases to 150° F. and thereby save about 13 percent fuel. Lower temperatures are possible and would increase the savings. In addition, convection losses to the stack would be eliminated during furnace shutdown and this would provide additional savings.

The regenerators or heat sinks will usually be mounted vertically so that condensate from the cooled flue gas will drain through the beds to collection zones in the bottom of the regenerator vessels. Beds of solid particulates in the regenerators may be divided into multiple layers separated by gaps or layers of material with low thermal conductivity, to help slow temperature equalization between top and bottom of the regenerators. The regenerators or heat sinks may be separate vessels or integrated in a single unit.

The system and method of the present invention for the recovery of heat from combustion flue gas provides numerous salient advantages. Costly and sometimes scarce fuels are conserved and saved. Valuable and previously wasted heat in combustion flue gas is recovered and saved. This is especially important for small-scale furnaces such as those in private homes and dwellings and in apartment houses, because even though the loss of heat is not great in any individual instance, in the aggregate a very large amount of heat could be saved and fuel conserved if the system and method of the present invention was installed in even half of all the private homes and apartment houses in the United States. Thus the present system and method improves efficiency and economy in the usage of fuels by recovering heat from hot flue gas by preheating cold or ambient combustion air. Consequently the present system and method helps in alleviating the energy shortage and periodic energy crises which arise in the country due to shortage or scarcity of fuel, by recovering heat from fuel combustion in an improved manner and thereby conserving fuel and curtailing fuel usage. The present system is feasible and amenable to usage in small-scale furnace installations such as are to be found in private dwellings or homes, apartment houses, office buildings, public buildings or the like, as well as in large scale furnace installations such as those in plants e.g. chemical plants, factories, steam-electric power plants, and other commercial and industrial installations. An advantage is that the system and method is simple and efficient and of low capital cost, e.g. the system provides the simplest piping and instrumentation of all the possible alternates. The system is fail-safe and thus is suitable for installation even in a domestic furnace such as are to be found in private dwellings and homes, and in apartment houses. The present system is better than alternate systems that would use on-off valves to direct the flow of combustion air and flue gas, which alternate systems present design difficulties and reduced safety. The present system allows a pressure in the furnace very close to atmospheric, because it is a dual fans system. Since the system uses dual fans, as opposed to a single fan, only a slight negative pressure is maintained in the furnace in both modes of operation. The present system has greater safety, reliability and economic impact than comparable systems of this type. The system is amenable to usage in small scale installations, as compared to known large scale items which are in continuous operation, receive regular maintenance and are regularly inspected by operators. A system is provided for economical regenerative air preheaters which is acceptable in domestic furnace applications, and in which a much simpler means of flow control is necessary. An advantage is that the system features fans which operate alternately in the forced draft and induced draft modes. Heat is recovered from combustion flue gas, and combustion air is concomitantly preheated, in a more efficient manner. Fuel is saved in a combustion process. The provision of reversing fans eliminates the need for a valve in the cold and corrosive exhaust gas (flue gas). The need for a reversing or switching valve in a system for the recovery of heat from flue gas is eliminated, and thus the reliability of such a system is improved by eliminating an additional moving part, and allowing normal operation automatically without operator supervision. Finally, an advantage is that a reversing or switching valve, which is subject to swings in temperature whenever the cycle changes from heating to cooling or vice versa, which in time causes the valve to jam or leak, and which is exposed to corrosive attack by sulfuric acid and sulfurous acid derived from sulfur dioxide in the flue gas, is eliminated.

The invention accordingly consists in the features of construction, combination of elements, arrangement of parts and series of steps which will be exemplified in the system and method hereinafter described, and of which the scope of application is as elucidated supra and as will be indicated in the appended claims.

BRIEF DESCRIPTION OF THE DRAWINGS

In the accompanying drawings in which are shown several of the various possible embodiments of the invention.

DETAILED DESCRIPTION OF THE PREFERRED EMBODIMENTS

Figure 1:
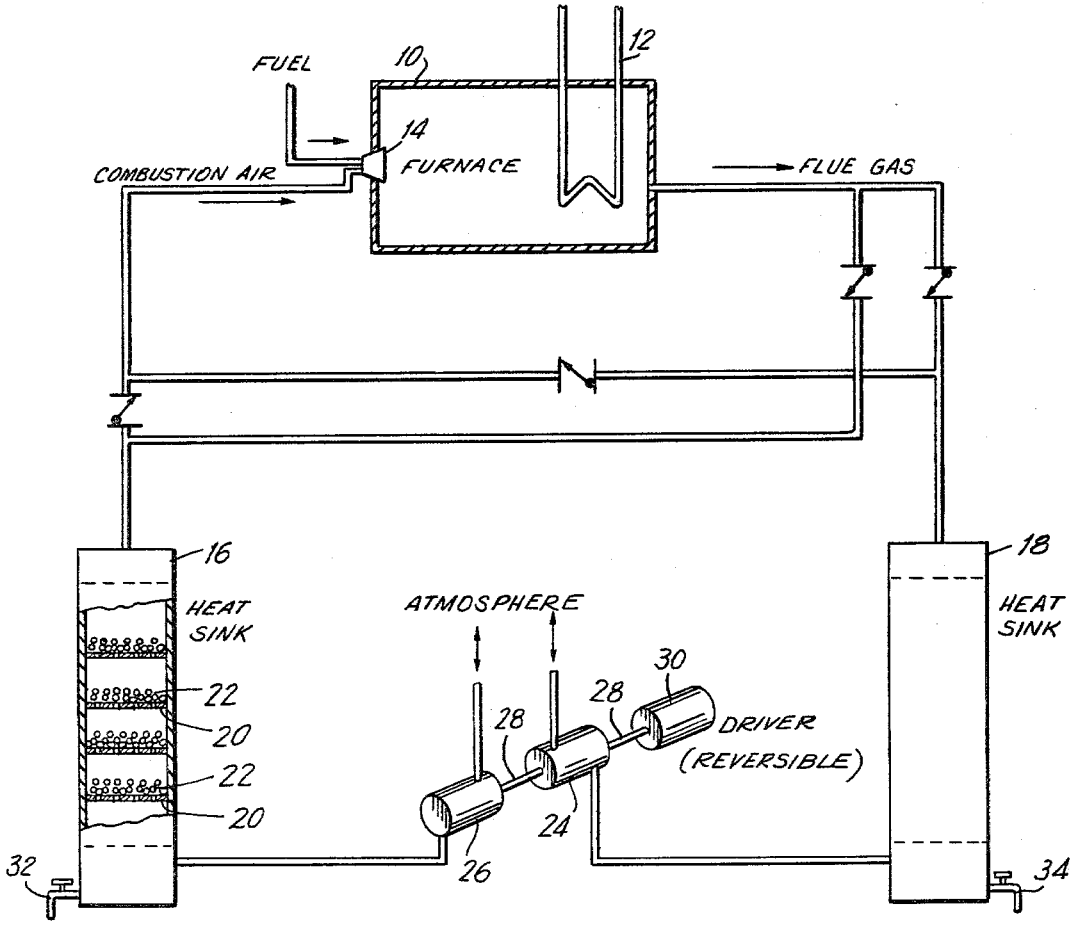
FIGS. 1, 1*a* and 1*b* are flowsheets illustrating an embodiment of the present invention principally applicable to an on-off furnace such as a domestic or home heating furnace as are to be found in private homes and dwellings.
Figure 1A:
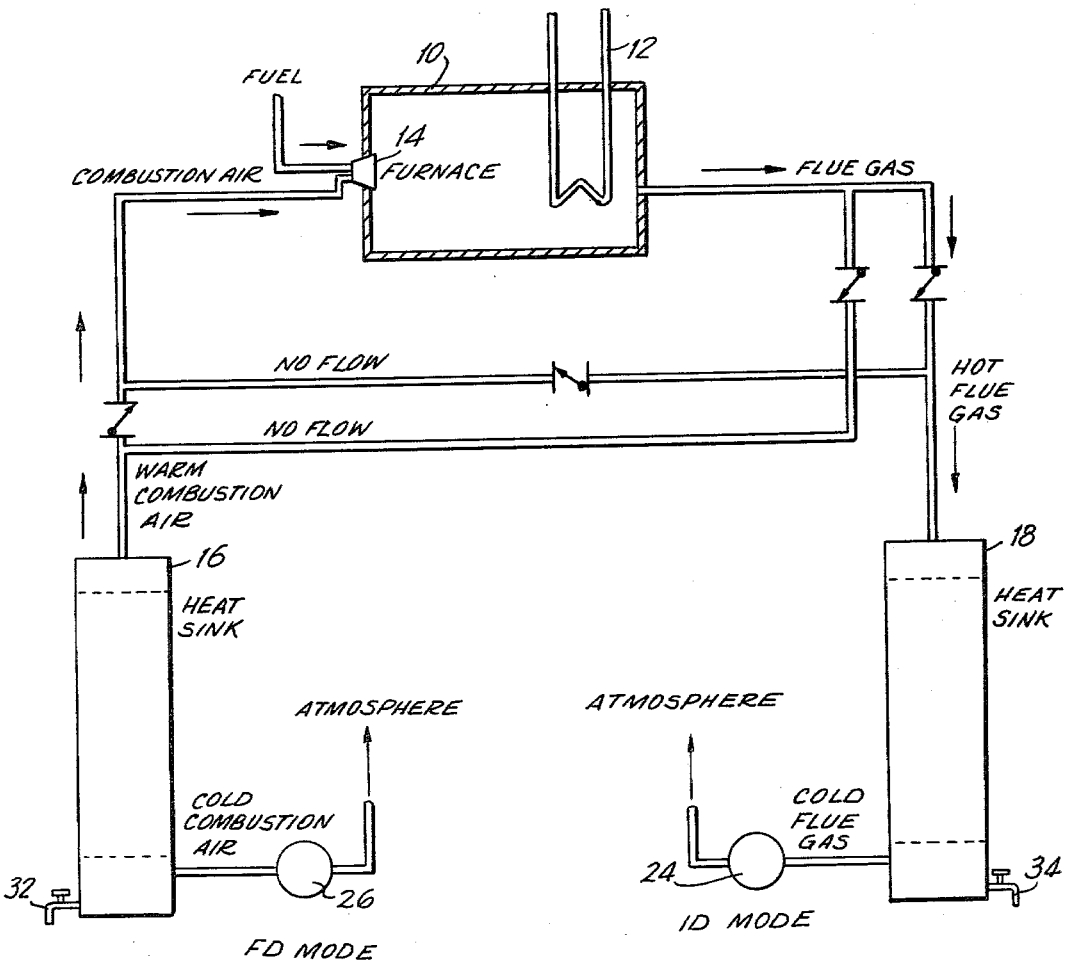
Figure 1B:
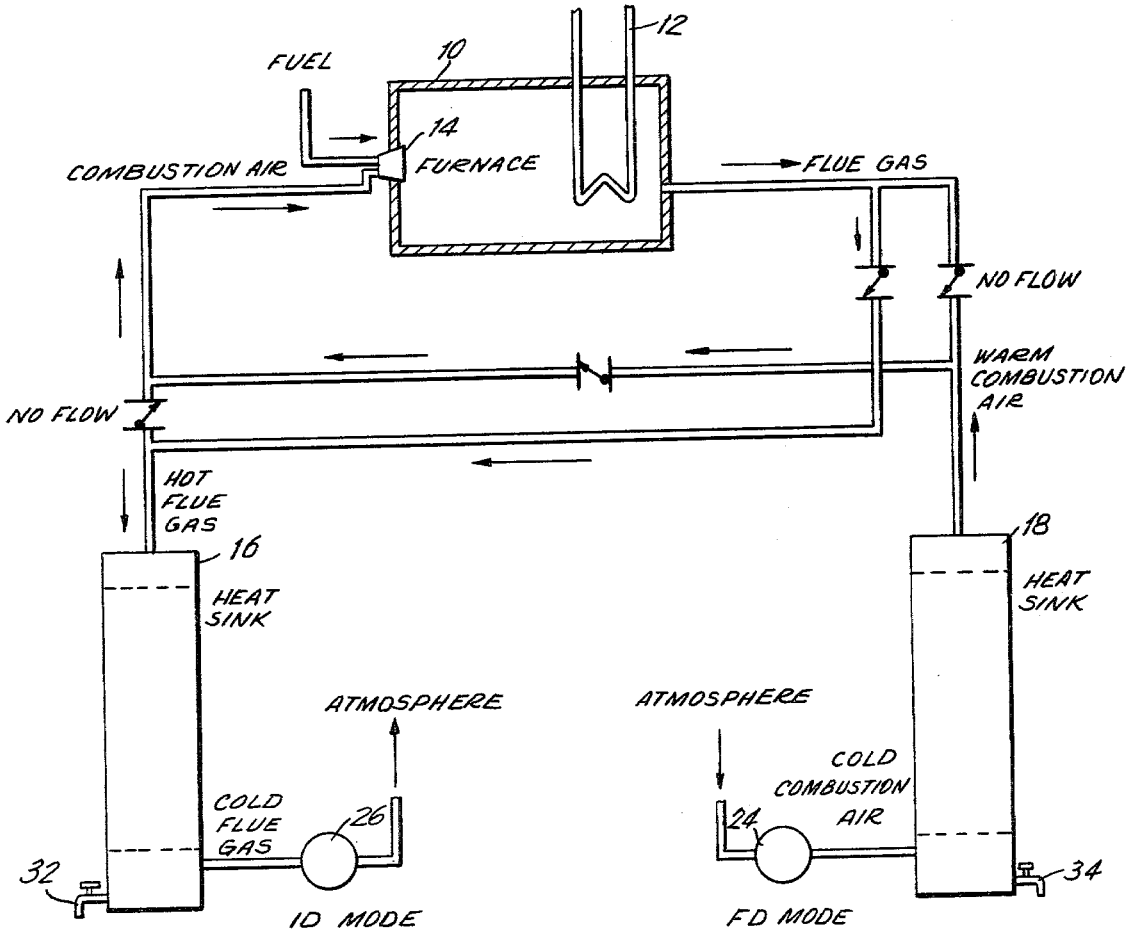

Referring now to FIGS. 1, 1*a* and 1*b*, the valves as shown are check valves or on-off valves, with one-way flow in the direction of the arrow. The specific reversing modes of operation are shown in FIGS. 1*a* and 1*b*. The FIGS. 1, 1*a* and 1*b* show a furnace 10 with a coil 12 through which a fluid to be heated and/or vaporized is circulated. Fuel is burned with combustion air at burner 14 in the furnace 10. The combustion air is preheated by heat recovered from the flue gas.

Two heat sinks 16 and 18 are used in rotation to exchange heat between the flue gas and the combustion air. FIG. 1 shows in cutout an exemplary heat sink configuration in which in heat sink 16, a plurality of foraminous trays 20 are provided, with a layer 22 of solid particulate material being disposed on each tray. At any time that the furnace 10 is in operation, the flue gas is passing through one heat sink while the combustion air is passing through the other. Thus, one sink is heating up while the other is cooling down. When the furnace 10 is shut down and restarted, the heat sinks are reversed, thus transferring the flue gas heat to the combustion air. The heat sinks may contain rocks or metal filler material, or glass spheres or the like. To counteract temperature equalization between top and bottom of the heat sinks when the furnace 10 is shut down, the heat sinks, e.g. heat sink 16 in FIG. 1, may consist of multiple layers 22 of rock or metal filler separated by gaps of air or material of low thermal conductivity.

When the system is operated in the mode depicted in FIG. 1*a*, fan 24 acts as ID fan and fan 26 acts as an FD fan. When the system is operated in the mode depicted in FIG. 1*b*, fan 24 acts as an FD fan and fan 26 acts as ID fan. Fans 24 and 26 may be linked by a common drive shaft 28 to increase their interdependence and thereby the system's simplicity and safety; the fans 24, 26 operate alternately in the FD/ID mode and can be mechanically interconnected if desired. As discussed supra, fans which operate alternately in the FD and ID modes are a key feature of the present invention. The forward and reverse motion of the fans can be achieved by a single electric motor 30 (by reversing the current), or by multiple motors or steam turbine drives. The fans 24, 26 can be separated or on a common shaft as shown. As mentioned supra, the reversing fan eliminates the need for a valve in the cold and corrosive exhaust gas. In this regard condensate drains 32, 34 are shown for the respective heat sinks 16, 18.

Thus FIGS. 1, 1*a* and 1*b* show the invention as applicable to an on-off furnace. The home heating furnace is an example of this type of furnace and is switched on and off by a thermostat which controls the temperature of the zone being heated. Consequently, a scheme using the reversing fan principle that is suited to this application is shown in FIGS. 1, 1*a* and 1*b*.

The regenerators or heat sinks 16, 18 should be mounted vertically so that condensate from the cooled flue gas will drain through the beds to collection zones in the bottom of the regenerator vessels 16, 18. The beds of solid particulates 22 in the regenerators 16, 18 are divided into multiple layers separated by air gaps or layers of material with low thermal conductivity, to help slow temperature equalization between top and bottom of the regenerators when the furnace 10 is shut down. The regenerators 16, 18 may be separate vessels as shown, or integrated in a single unit.

The flow of air through the furnace and regenerators will be minimal when the furnace is shut down, because the configuration of the furnace and regenerators blocks convection losses. Thus the convection losses normally sustained by on-off furnaces will be greatly reduced.

Figure 2:
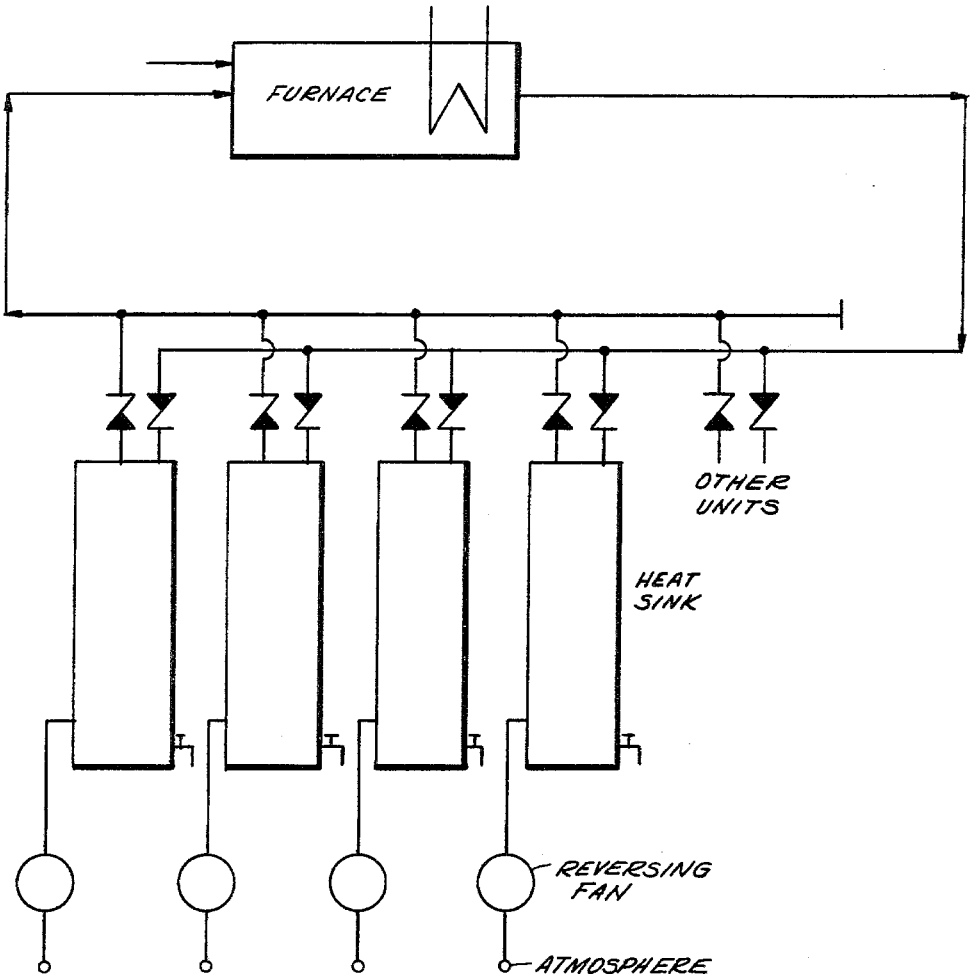
FIG. 2 is a flowsheet illustrating an alternative embodiment of the present invention principally applicable to a continuous furnace such as an industrial furnace to be found in plants such as chemical plants, factories, and steam-electric power plants.

FIG. 2 shows multiple heat sink units to permit continuous furnace operation as in an industrial furnace. Heat sinks are switched from the heating to the cooling cycle one at a time to avoid any interruption in furnace firing. FIG. 2 thus shows the scheme as applied to a continuous furnace; most industrial furnaces operate on a continuous basis. As shown in FIG. 2, multiple regenerators are used. Sufficient regenerators can be used so that when two or four are taken off line, there is no significant interruption in the operation of the furnace. Beds can be operated in pairs, and taken off line together, and always operated in opposing heating/cooling cycles.

It thus will be seen that there is provided a system and method for the recovery of heat from flue gas generated by the combustion of a fuel which achieves the various objects of the invention and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limited sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A system for recovering heat from combustion flue gas using combustion-supporting air which comprises (a) providing a fuel stream and a preheated combustion air stream, (b) burning said fuel stream with said combustion air stream in a combustion zone, whereby useful heat is produced and a combustion flue gas stream is generated at highly elevated temperature, (c) providing a first heat sink and a second heat sink, each of said heat sinks constituting a means to alternately absorb heat from a hot gas stream, whereby said hot gas stream is cooled, and desorb heat into a cold gas stream, whereby said cold gas stream is heated, (d) providing a first reversible fan means associated with said first heat sink, and a second reversible fan means associated with said second heat sink, together with respective means to drive said first fan means and said second fan means, (e) passing said combustion flue gas stream successively through said first heat sink and said first fan means to atmospheric discharge for a first finite time interval, while concomitantly passing a cold combustion air stream successively through said second fan means and said second heat sink, whereby atmospheric air enters the system through the second fan means functioning in a forced draft (F.D.) mode and then passes through the second heat sink, where the air is warmed, to the combustion zone where the warmed air is burned with the fuel and then flows through the first heat sink in which the gaseous products are cooled and the first fan means, said first fan means operating in the induced draft (I.D.) mode, to exit to the atmosphere; and (f) reversing said first and second reversible fan means after said first finite time interval and for a second finite time interval, and passing said combustion flue gas stream to said second heat sink while concomitantly passing the hot gas stream discharged from said first heat sink to said combustion zone during said second time interval, so that during said second time interval atmospheric air enters the system through the first fan means functioning in a forced draft (F.D.) mode and then passes through the first heat sink, where the air is warmed, to the combustion zone where the warmed air is burned with the fuel and then flows through the second heat sink in which the gaseous products are cooled, and the second fan means, said second fan means functioning in the induced draft (I.D.) mode, to exit to the atmosphere, whereby an additional increment of preheated combustion air stream is formed in said first heat sink.

2. The system of claim 1 in which the first and second finite time intervals are each in the range of about 2 to 20 minutes duration.

3. The system of claim 1 in which the first and second finite time intervals are of substantially equal duration.

4. The system of claim 1 in which the cold combustion air stream is ambient atmospheric air.

5. The system of claim 1 in which the fuel stream is a fossil fuel selected from the group consisting of natural gas principally comprising methane, crude oil, refined fuel oil, and coal.

6. The system of claim 1 in which the first and second reversible fan means are driven by a common primary drive.

7. The system of claim 6 in which the common primary drive is a reversible drive means in which the sense of rotation is reversed between the first and second time intervals.

8. The system of claim 6 in which the common primary drive is an induction-type electric motor or a steam turbine.

9. The system of claim 1 in which the first reversible fan means operates in an induced draft mode during the first finite time interval and in a forced draft mode during the second finite time interval, and in which the second reversible fan means operates in a forced draft mode during the first finite time interval and in an induced draft mode during the second finite time interval.

10. The system of claim 1 in which each of the heat sinks is an enclosure filled with a solid particulate material selected from the group consisting of brick checkerwork, rocks, metal filler, alumina, magnesia, silica, glass and quartz.

11. The system of claim 1 in which the combustion flue gas is cooled from an initial temperature in the range of about 300° F. to about 1200° F., to a final temperature in the range of about 100° F. to 400° F., and the combustion air is preheated from ambient temperature to a final temperature in the range of about 200° F. to 1100° F.

* * * * *